US007874971B2

(12) United States Patent
Reyes

(10) Patent No.: US 7,874,971 B2
(45) Date of Patent: Jan. 25, 2011

(54) CALF EXTENSION TRAINING DEVICE

(75) Inventor: Gil Reyes, Las Vegas, NV (US)

(73) Assignee: GRAA Innovations, LLC, Las Vegas, NV (US)

( * ) Notice: Subject to any disclaimer, the term of this patent is extended or adjusted under 35 U.S.C. 154(b) by 0 days.

(21) Appl. No.: 12/383,625

(22) Filed: Mar. 25, 2009

(65) Prior Publication Data

US 2010/0248917 A1 Sep. 30, 2010

(51) Int. Cl.
*A63B 21/00* (2006.01)

(52) U.S. Cl. ..... 482/133; 482/135; 482/130

(58) Field of Classification Search ..... 482/133, 482/92–96, 142, 148, 51, 139, 14, 52, 79, 482/908, 130, 135
See application file for complete search history.

(56) References Cited

U.S. PATENT DOCUMENTS 339,638 A * 4/1886 Goldie ..... 482/96
1,902,694 A 3/1933 Edwards
3,116,062 A 12/1963 Zinkin
3,373,993 A 3/1968 Oja et al.
3,524,644 A 8/1970 Kane
3,602,501 A * 8/1971 Garner ..... 482/145
3,640,529 A 2/1972 Kane
3,709,488 A * 1/1973 Garner ..... 482/145
3,749,400 A 7/1973 Stoffel
3,874,656 A 4/1975 Wintersteller
3,892,404 A * 7/1975 Martucci ..... 482/96
4,004,801 A * 1/1977 Campanaro et al. ..... 482/96
4,101,124 A * 7/1978 Mahnke ..... 482/96
4,176,836 A * 12/1979 Coyle ..... 482/96
4,316,608 A * 2/1982 Lundberg ..... 482/94
4,333,644 A * 6/1982 Lambert et al. ..... 482/101
4,340,218 A 7/1982 Wilkinson
4,383,684 A * 5/1983 Schliep ..... 482/96
4,684,126 A 8/1987 Dalebout et al.
4,706,953 A 11/1987 Graham
4,804,180 A 2/1989 Salaz
4,826,158 A * 5/1989 Fields, Jr. ..... 482/142
4,915,378 A * 4/1990 Abrahamian et al. ..... 482/137
4,930,769 A * 6/1990 Nenoff ..... 482/96
5,066,005 A 11/1991 Luecke
5,162,031 A 11/1992 Watson
5,263,913 A 11/1993 Boren
5,411,457 A * 5/1995 Hartdegen et al. ..... 482/96
5,433,685 A * 7/1995 Winslow et al. ..... 482/96
5,626,548 A * 5/1997 Coyle ..... 482/137

(Continued)

*Primary Examiner*—Lori Baker
(74) *Attorney, Agent, or Firm*—Weide & Miller, Ltd.

(57) ABSTRACT

A calf extension training device which focuses training on the calf muscles is disclosed herein. The training device may comprise a frame, base, riser, sled, and one or more springs. The sled may comprise a sled frame and shoulder extensions, and is configured to move along the length of the frame while attached to one or more springs. Generally, the user stands on the riser leaving the user's heels unsupported while the user's shoulders are engaged by the shoulder extensions of the sled. The user may then lift and lower the sled using his or her calf muscles. This occurs by the user raising or lowering his or her body by extending and flexing the ankles. Resistance may be provided by one or more springs attached to the sled and the frame. The springs may provide variable resistance against the force of the user's calf muscles.

26 Claims, 4 Drawing Sheets

U.S. PATENT DOCUMENTS 5,681,249 A * 10/1997 Endelman ..... 482/142
5,733,229 A * 3/1998 Dalebout et al. ..... 482/96
5,885,197 A * 3/1999 Barton ..... 482/144
5,964,684 A * 10/1999 Sokol ..... 482/96
5,967,950 A * 10/1999 Hsu ..... 482/96
6,120,425 A * 9/2000 Endelman ..... 482/142
6,186,929 B1 * 2/2001 Endelman et al. ..... 482/121
6,244,995 B1 * 6/2001 Prsala ..... 482/96
6,251,052 B1 6/2001 Simonson
6,338,704 B1 * 1/2002 Endelman ..... 482/142
6,371,895 B1 * 4/2002 Endelman et al. ..... 482/135
6,478,721 B1 11/2002 Hunter
6,482,134 B1 * 11/2002 Rasmussen ..... 482/96
6,527,685 B2 * 3/2003 Endelman et al. ..... 482/121
6,632,160 B2 * 10/2003 LaFond et al. ..... 482/95
6,752,745 B1 6/2004 Davis
6,786,847 B1 * 9/2004 Morgan et al. ..... 482/6
6,796,928 B1 9/2004 Christopher et al.
6,926,650 B2 * 8/2005 Endelman et al. ..... 482/121
6,971,976 B2 * 12/2005 Endelman et al. ..... 482/121
6,981,934 B1 * 1/2006 Shifferaw ..... 482/133
D515,640 S * 2/2006 Carter ..... D21/673
7,125,369 B2 * 10/2006 Endelman ..... 482/142
7,125,370 B1 * 10/2006 Schaffner et al. ..... 482/142
7,163,498 B1 * 1/2007 Abelbeck ..... 482/142
7,163,500 B2 * 1/2007 Endelman et al. ..... 482/142
7,288,053 B2 * 10/2007 Endelman et al. ..... 482/142
7,331,908 B2 * 2/2008 Olsen ..... 482/99
7,331,914 B2 * 2/2008 Carlucci et al. ..... 482/148
7,465,261 B2 * 12/2008 Barnard et al. ..... 482/142
7,597,656 B2 * 10/2009 Trees ..... 482/142
2009/0197746 A1 8/2009 Splane et al.

* cited by examiner

CALF EXTENSION TRAINING DEVICE

BACKGROUND OF THE INVENTION

1. Field of the Invention

The invention relates to a resistance training device for training the lower extremities and specifically the muscles and other structures of the calf and lower leg.

2. Related Art

Calf muscles are used in walking, running, jumping, and in nearly every sport. It is thus desirable to have a training device configured to focus training on these muscles and their corresponding body structures. Traditional training devices such as hack squat devices focus on the muscles of the thigh rather than on the calf muscles. A user of a traditional device may not be able to achieve the calf muscle training he or she desires because of the configuration of traditional devices. For instance, traditional devices allow a user to use other muscles, such as thigh muscles to offload weight or resistance. This consequently reduces the effectiveness of training on the calf muscles which the user is seeking.

In traditional devices, the user must be relatively skilled and maintain proper technique to achieve focused training on his or her calf muscles. Training of the calf muscles may be achieved without proper technique; however, such training will not be as effective in training the calf muscles because the user's other muscles are offloading weight or resistance from the user's calf muscles.

In addition, traditional devices using a fixed resistance do not provide variable resistance and are incapable of maximizing resistance across the range of motion of a user's legs. Thus, the same resistance or weight is provided regardless of how the user's legs are positioned. For this reason, the user may not receive the desired amount of resistance as the user moves during training.

Thus, what is disclosed herein is a novel calf extension training device that provides variable and adjustable resistance while focusing training on a user's calf muscles.

SUMMARY OF THE INVENTION

A calf extension training device which focuses training on the calf muscles is disclosed herein. In one embodiment, the training device comprises a platform extending from a base, one or more risers attached to the platform configured to engage only a front portion of at least one of a user's feet, a frame having one or more frame attachment points, and a sled configured to move along the length of the frame. It is noted that the one or more risers may be adjustable in some embodiments.

The sled may comprise a sled frame, one or more shoulder extensions extending outward from the top of the sled frame, and one or more sled attachment points. The shoulder extensions may be configured to engage one or more of the user's shoulders. The sled may also include one or more handholds, and may have a padded sled frame or padded shoulder extensions.

One or more resistance devices may be configured to provide resistance as the sled is lifted and lowered. The resistance devices may be attached to the one or more frame attachment points and the one or more sled attachment points. For example, a plurality of sled attachment points may be attached at a bottom end of the sled frame, or a plurality of frame attachment points may be attached at a bottom end of the frame in some embodiments. The resistance devices may also be removably attached to the one or more frame attachment points and the one or more sled attachment points In one or more embodiments, the frame may extend upward from the base. It is contemplated that in some embodiments, the frame may comprise two parallel C shaped beams configured to accept one or more wheels attached to the sled.

In another embodiment, the calf extension training device comprises a base, a frame extending upward at an angle from the base, a platform attached to the base, one or more risers attached to the platform configured to engage only a front portion of at least one of a user's feet, and a sled. The frame may have a top end, a bottom end, and one or more frame attachment points at the bottom end. The frame may comprise two parallel C shaped beams, the parallel C shaped beams configured to accept one or more wheels attached to the sled. In addition, at least a portion of the platform may extend upward at an angle from the base. The portion of the platform that extends upward at an angle from the base may extend at an angle perpendicular to the frame in some embodiments. It is contemplated that the platform may be attached to and extend from the frame.

The sled may be configured to be lifted and lowered along the length of the frame, and comprise a sled frame having a top end and a bottom end configured to engage the user's back, two shoulder extensions at the top end of the sled frame and one or more sled attachment points at the bottom end of the sled frame. The sled may have a padded sled frame, padded shoulder extensions, or both and include one or more hand holds in some embodiments. One or more resistance devices configured to provide resistance as the sled is lifted and lowered may be attached to the one or more frame attachment points and the one or more sled attachment points.

As with above, the riser may be adjustable. In one embodiment, the training device further comprises one or more riser guides configured to accept one or more riser extensions attached to the riser. In this manner, the position of the riser may be adjusted and then secured by one or more pins inserted into one or more holes formed in one or more sides of the one or more riser guides. The position of the riser may also be secured by one or more threaded pins threaded into one or more threaded holes formed in the one or more sides of the one or more riser guides.

A method of calf training is also disclosed herein. The method, in one or more embodiments, comprises providing a frame extending upward from a base and a sled, engaging a front portion of one or more of the user's feet with at least one riser attached to a platform at the bottom end of the frame, engaging the user's shoulders with the one or more shoulder extensions, and resisting the motion of the sled as the sled is lifted by an upward force generated by the user extending one or more of the user's ankles while the front portion of one or more of the user's feet remain engaged to the at least one riser.

The sled may be configured to move along the length of the frame and comprise one or more shoulder extensions extending from a sled frame. One or more resistance devices may be attached to the sled by one or more sled attachment points and attached to the frame by one or more frame attachment points to provide resistance as the sled is lifted and lowered by a user;

The method of calf training may also comprise returning the sled to a lower position when the upward force generated by the user is insufficient to lift the sled. In addition adjusting the resistance provided by the one or more resistance devices by adding, removing, or replacing the one or more resistance devices, and adjusting the position of the riser may be included in one or more embodiments of the method.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Generally, the calf extension training device is configured to provide resistance training to the calf muscles. Training these muscles may be beneficial to other nearby body structures like joints and tendons as well, such as by increasing flexibility and range of motion. In addition, training of the calf muscles is beneficial to athletes and non-athletes alike because calf muscles are used in standing, walking, running, and jumping. The training device is well suited for rehabilitation as well as training because one or more embodiments of the training device may be adjustable to a user's strength, size, or other physical characteristics.

As will be described further below, training of the calf muscles generally occurs according to the method and apparatus herein by the user lifting and lowering a resistance which exerts a downward force upon the user's shoulders. This lifting and lowering is accomplished by the user extending or flexing his or her ankles while front portions of the user's feet are supported by an element of the apparatus. The calf muscles are attached at the heel of the foot and at a posterior section of the leg just below the knee and thus are heavily used and trained in extending and controlling movement of the ankle and foot.

Figure 1:
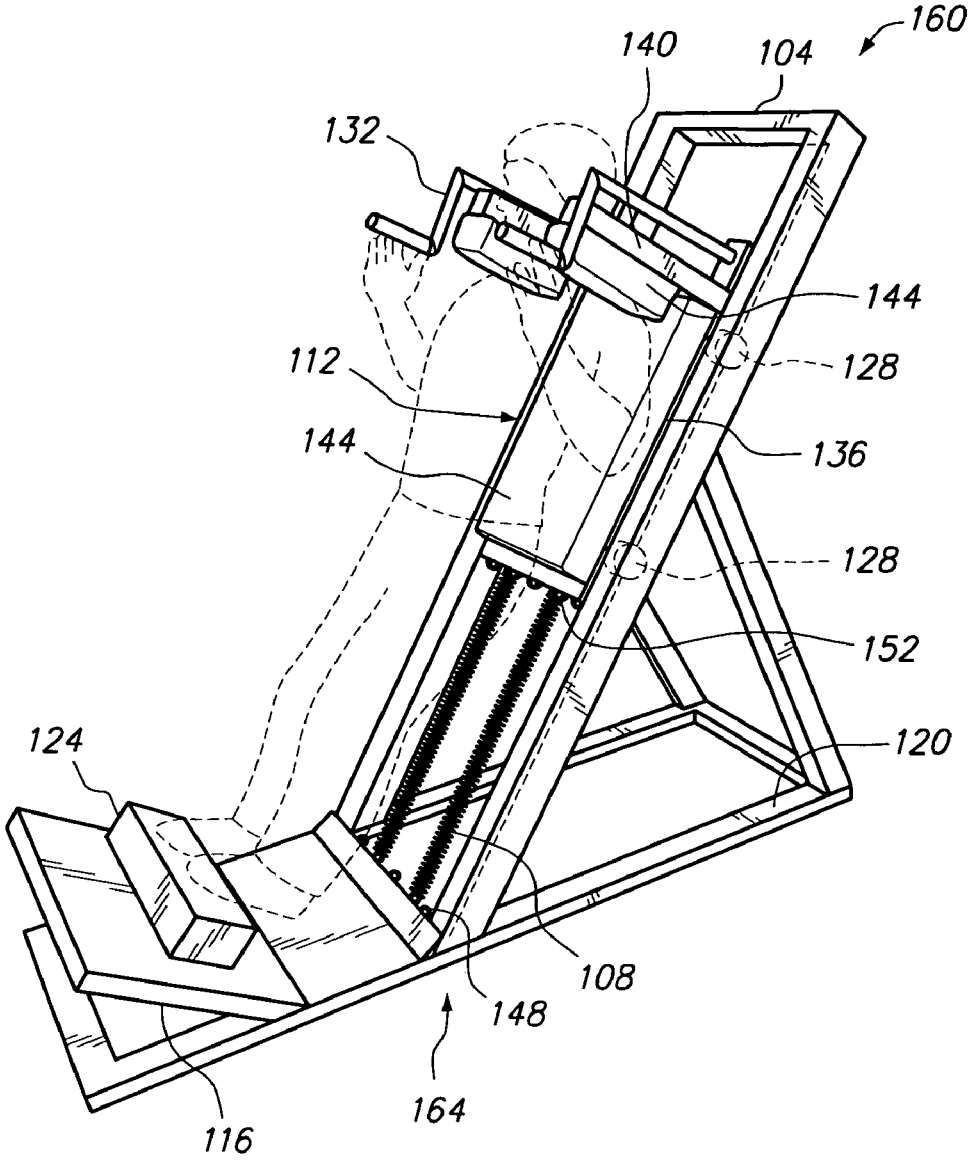
FIG. 1 illustrates a perspective view of an embodiment of the invention.

FIG. 1 illustrates a perspective view of an embodiment of the invention. In this example embodiment, the calf extension training device includes a frame 104 with a base 120. Generally, the frame 104 provides a structure upon which the base 120, and other elements of the training device may be attached. The frame 104, base 120, and other elements of the training device may be attached by various fasteners, structures, or both such as but not limited to welds, screws, rivets, nuts, bolts, and adhesives. The frame 104 has a top end 160 and a bottom end 164. As illustrated, the training device comprises a plurality of tubes or bars having square or rectangular cross sections. However, it is noted that in one or more embodiments, these tubes or bars may have cross sections of different shapes and sizes. For example, the cross sections may be circular, hexagonal, or other shapes. In addition, the cross sections the cross sections may be I shaped (similar to an I-beam) or C shaped as well.

As shown in the embodiment of FIG. 1, the frame 104 is an elongated structure extending upward from the base 120. The frame 104 may comprise two parallel beams or pillars attached to a base 120 and extending upwardly therefrom. In some embodiments, the frame 120 may extend upward at an angle such as shown in FIG. 1. Generally, this angle is advantageous in that it allows a user to lean or recline back into the calf extension training device as will be discussed further below. Of course, the frame 120 may extend perpendicular to the base if so desired or in any other angle relative to a horizontal plane.

Various configurations are possible, and thus it is contemplated than any frame 104 capable of supporting the elements of the training device such that they operate according to the description herein may be used. For example, the frame 104 may be square or rounded in shape. In addition, the frame 104 may have fewer or additional horizontal beams or members extending from various points along its vertical length, or the frame may include diagonal members in one or more embodiments. It is contemplated that the frame is formed from rigid materials such as but not limited to steel, aluminum, carbon fiber, or one or more other metals or alloys.

The base 120 in one or more embodiments is a generally planar rigid structure that may be formed from similar materials and structures as the frame. The base 120 may have various shapes and sizes as well. The base 120 ensures that the frame 104 remains stationary and stable when the calf extension training device is in use and when it is not in use. In some embodiments, the base 120 may be secured to the floor so as to provide additional support such as to resist tipping. In other embodiments, the base 120 may be sufficiently large such that the training device remains stationary and stable without being secured to the floor. It is contemplated that a base 120 may not be necessary in all embodiments, as the training device may be secured to one or more walls. The training device may be secured with various fasteners such as but not limited to screws, brackets, nuts and bolts, or a combination thereof. In some embodiments, the frame 104 may be configured such that it is stationary and stable without a base 120.

In one or more embodiments a platform 116 is provided to support the user's feet. Like the frame 104, the platform 116 may extend upward from the base 120 at various angles. For example, the platform 116 may extend from the base 120 at an angle such that it is perpendicular to the frame 104 or at any other angle. It is noted that the platform 116 may be attached to and extend from the frame 104 rather than the base 120 in some embodiments. For example, the platform 116 may be attached at the bottom end of the frame 104 and extend perpendicular or at an angle therefrom.

As illustrated in FIG. 1, the platform 116 is a planar rigid structure attached to the base 120 having one or more bends such that a portion of the platform extends upward from the base 120. In this embodiment, the platform 116 extends such that it is perpendicular to the frame 104. Of course, as stated, the platform 116 may extend at other angles as desired.

In one or more embodiments, a riser 124 may be attached to the top side of the platform 116 and extend upward therefrom. The riser 124 generally provides a raised area above the platform 116 which may be engaged by a front portion of either or both of the user's feet leaving the back or heel portion thereof unsupported. As shown in FIG. 1, the riser 124 is a rectangular shaped box, however, the riser 124 may take various forms. For example, the riser 124 may have a different shape such as a square, rounded, or other shape. In addition, the riser 124 may be a shelf or bar, and may comprise two or more separate portions for each foot. It is contemplated that any structure that provides a raised area above the platform 116 that may engage at least a portion of either or both of a user's feet may be used as a riser 124.

Figure 2:
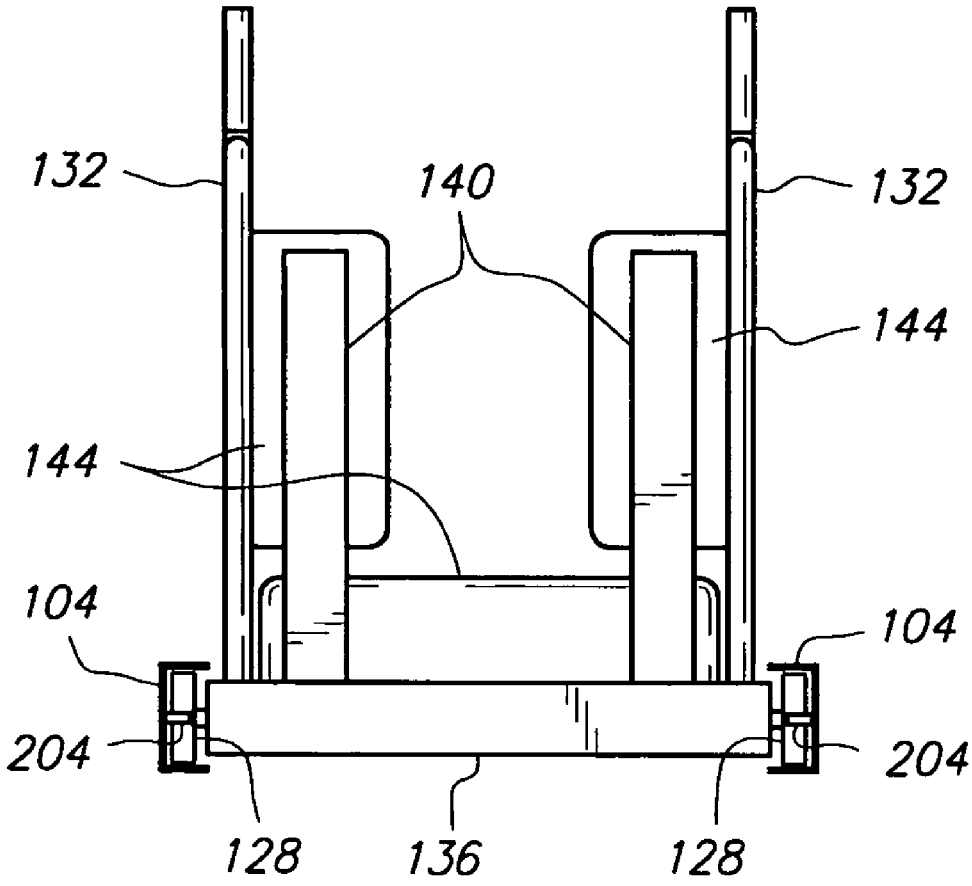
FIG. 2 illustrates a top view of the sled of an embodiment of the invention.

As FIGS. 1 and 2 illustrate, in one or more embodiments, the calf extension training device includes a sled 112 configured to move along the length of the frame 104 as it is moved such as by, lifting and lowering, by a user during training. For example, the sled 112 may comprise a planer sled frame 136 having shoulder extensions 140 extending perpendicular from the sled frame at the top of the sled frame. Generally, as will be described further below, the shoulder extensions 140 engage a user's shoulders during training so that the resistance provided by the training device is applied to the user through his or her shoulders. It is contemplated that the shoulder extensions 140 may extend at various angles and may be configured to swing into and out of place to allow a user to more conveniently use the training device.

In one or more embodiments, two shoulder extensions 140 are attached at the top of the sled frame 136 such that they extend perpendicularly from the sled frame while being parallel to each other. As stated, the shoulder extensions 140 may engage a user's shoulders during training. Thus, the shoulder extensions 140 may be spaced apart such that a users head or neck may be placed or inserted therebetween allowing the each shoulder extension to be in contact with each of the user's shoulders. As discussed further below, the shoulder extensions 140 have the advantage of focusing training on the calf muscles because other muscles generally are not used when a user is lifting the sled 112. This is because the shoulder extensions 140 allow the sled 112 and its corresponding resistance to be applied downward to the user's body through the shoulders. The user may then move the sled 112 with the moving force almost completely being provided by his or her calf muscles, as will be discussed further below.

Of course, rather than being configured to engage the user's shoulders, the sled 112 may be a structure configured to engage a user's arms, hands, torso, shoulders or a combination thereof without shoulder extensions 140. For example, rather than shoulder extensions 140, the sled 112 may comprise handlebars extending outward from the sled frame 136 that a user may grasp with his or her hands during training. In another embodiment, the sled 112 may comprise one or more shoulder straps attached to a sled frame 136. As stated however, the shoulder extensions 140 provide the advantage of focusing training on the calf muscles, since only the calf muscle need be flexed to move the sled against the resistance.

The sled 112 may include additional elements as well. In one embodiment, the sled 112 may include one or more hand holds 132 attached to the sled frame 136. In this embodiment, the hand holds 132 may be grasped by a user while training such as to place the arms in a comfortable position during training. In one embodiment, the sled 112 may include one or more pads 144 which allow the user to more comfortably engage the sled during training. For example, one or more pads 144 may be provided on the sled frame 136, the shoulder extensions 140 or both.

Also, one or more sled attachment points 152 may be attached at the bottom of the sled frame 136. As will be described further below, the sled attachment points 152 allow one or more springs 108 to be permanently or removably attached to the sled 112 in one or more embodiments.

The one or more hand holds 132 may be used to stabilize a user as he or she trains. However, a hand hold 132 is also advantageous where the training device is used for rehabilitation. Users undergoing rehabilitation may have difficulty standing and thus a hand hold 132 may be provided to allow these users to stabilize themselves while using the calf extension training device. The one or more hand holds 132 located on the frame 104 may also be employed to enhance or stabilize training as well. For example, some manner of upper extremity training is realized when a user is using upper body strength to stabilize his or her body during training. In addition, it is contemplated that a user may use the hand holds 132, rather than the shoulder extensions 140, to lift the sled 112 during training.

The one or more hand holds 132 may be configured in various ways. In FIG. 1, a hand hold 132 is shown as a bent bar attached at the top of the sled frame 136. Of course, the hand holds 132 may be other types of handles or grips that a user can grasp during training. The hand holds 132 may be attached at the bottom or at any other point on the sled 112 as well. The user may grasp portions of the sled 112 as hand holds as well. It is contemplated that multiple hand holds 132 may be present in one or more embodiments.

The hand holds 132 may also allow a user to control one or more safety locks. In general, a safety lock will hold a sled 112 in place to protect a user from injury by physically or frictionally stopping motion of the sled relative to the frame 104. A safety lock may comprise one or more articulating or retracting stops which engage a portion of the frame 104 to hold a sled 112 in place. Safety locks, now known, such as those found on traditional squat machines, or later developed may be used with the apparatus herein.

In the event a user is suddenly (or otherwise) unable to carry or lift the sled, a safety lock may engage to hold the sled 112 allowing the user to safely disengage the device. In one or more embodiments, the user must squeeze or rotate a portion of the hand holds 132 to activate the safety lock. In another embodiment, the safety lock is activated unless the user squeezes or rotates a portion of the hand holds 132 to deactivate the safety lock to allow movement of the sled 112. In this embodiment, the safety lock automatically holds the sled 112 in place once the user releases the hand holds 132. This is advantageous because the user does not have to take specific action to activate the safety locks. It is contemplated that a safety lock may be activated and deactivated in ways other than the user squeezing or rotating a portion of the hand holds 132.

As stated, the sled 112 is configured to move along the length of the frame 104. In this manner, the sled 112 may be moved from a first lower position on the frame 104 to a second higher position and vice versa. In one embodiment, wheels 128 attached to the sled frame 136 allow the sled 112 to move or roll within the frame 104 when a user is training. The wheels 128 may be attached to the sled frame 136 through one or more axles extending outward perpendicular to the direction in which the sled 112 will move.

FIG. 2 illustrates a top view of an embodiment of a sled 136 showing the sled's wheels 128 held within the frame 104. In this embodiment, the upwardly extending beams of the frame 104 have a C shaped cross section sized to accept the wheels 128 of the sled 112. It can thus be seen that the sled 136 may be both lifted and lowered along the frame 104.

Of course, the sled 112 may be configured to move along the length of the frame 104 in various other ways. For example, a track may be attached to the frame 104 to accept the wheels 128 of the sled 112. In some embodiments, wheels may be attached to the frame 104 rather than attached to the sled 112. For example, a series of wheels along the length of the frame 104 and within the C shaped cross section of the frame's 104 beams may be provided. The sled frame 136 would then be able to roll along the length of the frame 104 on top of or in between the frame's wheels. It is contemplated that any device or structure capable of allowing the sled 112 to be lifted and lowered along the length of the frame 104 while retaining the sled within the frame may be used with the invention herein.

In one or more embodiments, the frame 104 may include one or more stops 204 to prevent the wheels 128 (and consequently the sled 112) from moving past a certain point. In this manner, a stop 204 may prevent the sled 112 from moving above a certain point or below a certain point. The one or more stops 204 may define the maximum range of motion for the sled 112 in one or more embodiments. It is contemplated that one or more stops 204 may be below the sled 112 to hold the sled at a position on the frame 104 when not in use. For example, the one or more stops 204 may hold the sled 112 at a raised position to allow a user to conveniently engage the sled 112 prior to starting his or her exercise.

A stop 204 may be any structure which blocks movement of a wheel 128. For example, a plate, one or more pins or rods, one or more protrusions, a narrow section of the frame, or a combination thereof may be attached or formed at any point along the frame 104 to block the movement of the wheels 128. To illustrate, as shown in FIG. 1, a crossbar or plate is at the top of the frame 104 which prevents the sled 112 from being lifted out the top end 160 of the frame. As shown in FIG. 2, a stop 204 in the form of a rod extending from the frame 104 prevents the wheels 128 from moving past a certain point.

It is contemplated that the stop 204 may be adjusted along the frame by a user in one or more embodiments. For example, a stop 204 may be moved upward to allow additional upward movement of the sled 112 or to raise the lowest point a sled may reach. A stop 204 may be moved downward to allow additional downward movement of the sled or to lower the highest point a sled may reach.

The frame 104 may include a series of openings in some embodiments to allow one or more stops 204 to be inserted therein. The stops 204 and openings may be configured such that, when inserted properly, at least a portion of a stop will contact the sled 112 or a part thereof to prevent motion of the sled past a certain point. It will be understood that the frame may utilize other structures besides openings to allow one or more stops 204 to be adjusted.

The sled 112 and some of its elements such as but not limited to the sled frame 136, shoulder extensions 140, and hand holds 132 may be formed from similar materials as the frame 104 as described above. Thus, in one embodiment, the sled frame 136 and shoulder extensions 140 may be formed from metal bars of various shapes and sizes.

Referring back to FIG. 1, the calf extension training device generally provides training by resisting the movement of its user through one or more resistance devices 108. Generally, a resistance device is a resilient spring or band which resists being stretched. In one or more embodiments, one or more springs 108 may be used as resistance. Note that, though the resistance herein is generally described as provided by a spring 108, it is contemplated that other resistance devices, such as elastic bands or elastic tubing, may be used alone or in combination with the springs 108 to provide resistance. For example, one or more elastic bands or elastic tubing may be used alone in combination with the springs 108 in some embodiments. The elastic bands may be configured to attach to the training device in a similar manner to the springs 108. [PLEASE PROVIDE ADDITIONAL EXAMPLES OF RESISTANCE DEVICES IF DESIRED]

A spring 108 is advantageous because it may provide variable resistance in one or more embodiments. A person's strength is not constant, but rather, varies as he or she moves. For example, the strength of a muscle may increase during flexion. It is also known that a resistance may be more or less easily moved by a fulcrum and lever depending on its position with respect the lever's fulcrum or pivot point. The body's skeletal structure contains many fulcrum and lever structures. For example, a person's arms and legs pivot along at one or more joints. Thus, resistance training with a fixed resistance is less effective than training with variable resistance because the resistance does not increase with as the body's strength increases.

In contrast, a variable resistance, in one or more embodiments, may increase with the body's strength. In this manner, training is more effective because a muscle must work against a resistance that increases as the muscle moves from its weakest to strongest position. Generally a muscle exerts its greatest force at or near full contraction and the least force when extended. A fixed resistance is limited, in that, the amount of resistance is generally the force a muscle can exert at its weakest position. Therefore, it can be seen that while fixed resistance may be sufficient for training the body at its weakest point, a lesser amount of training is achieved for the muscles used when the body is at stronger points.

The spring 108 may be adjusted to correspond to the varying strength of the calf muscles of a particular user. For example, the size and number of coils, or the thickness, rigidity, or both of the materials used to form a spring 108 may be varied across the length of the spring. In this manner the spring 108 may be configured to provide more or less resistance in a nonlinear manner as it is stretched. It is contemplated, that one or more fixed resistance devices, such as weights, may be used in addition to one or more variable resistance devices to increase resistance, if desired.

Generally, the spring 108 has two ends and is attached at one end to the sled attachment point 152 on the sled 112 and at the other end to a sled attachment point 148 on the frame 104. For example, one or more springs 108 may be attached to one or more sled attachment points at the bottom of the sled 112 and to one or more frame attachment points at the bottom end of the frame 104.

The sled attachment point 152 and the sled attachment point 148 may allow the spring 108 to be attached permanently. For example, the attachments may be welds or rivets which hold the spring 108 to the sled 112 and frame 104. It is contemplated that any one or more fasteners or structures, now known or later developed, capable of permanently securing the spring 108 to the sled 112 and the frame 104 may be used as well.

In some embodiments, the spring 108 may be removably attached. This allows a spring 108 to be removed and replaced for maintenance or to adjust the resistance provided by the calf extension training device. Removable attachment may be accomplished in various ways. For example, one or more screws, nuts, bolts, pins, clips, clamps, hooks, loops, or a combination thereof may be used. In one embodiment, both ends of the spring 108 have a hook which engages a sled attachment point 148 and a sled attachment point 152 comprising an eyelet or a loop. In one or more embodiments, either or both ends of the spring 108 may have a hole, hook, or eyelet, or loop to allow a screw, bolt, pin, or other removable fastener to be inserted therethrough. In other embodiments, the spring's 108 hole or loop may engage a frame attachment 148 or a sled attachment point 152 comprising a hook to allow the spring 108 to be removably attached. It is contemplated that any one or more fasteners or structures capable of removably securing the spring 108 to the sled 112 and the frame 104 may be used.

It is contemplated that a plurality of springs 108 may be attached in one or more embodiments. In these embodiments, multiple sled attachment points 152, frame attachment points 148, or both may be provided, or the individual sled and frame attachment points may be configured to allow multiple springs 108 to be attached thereto. The plurality of springs may be permanently or removably attached as described above. The amount of resistance provided may be adjusted by adding or removing one or more springs 108. Weight may be added to add resistance in addition to the springs 108.

Figure 3:
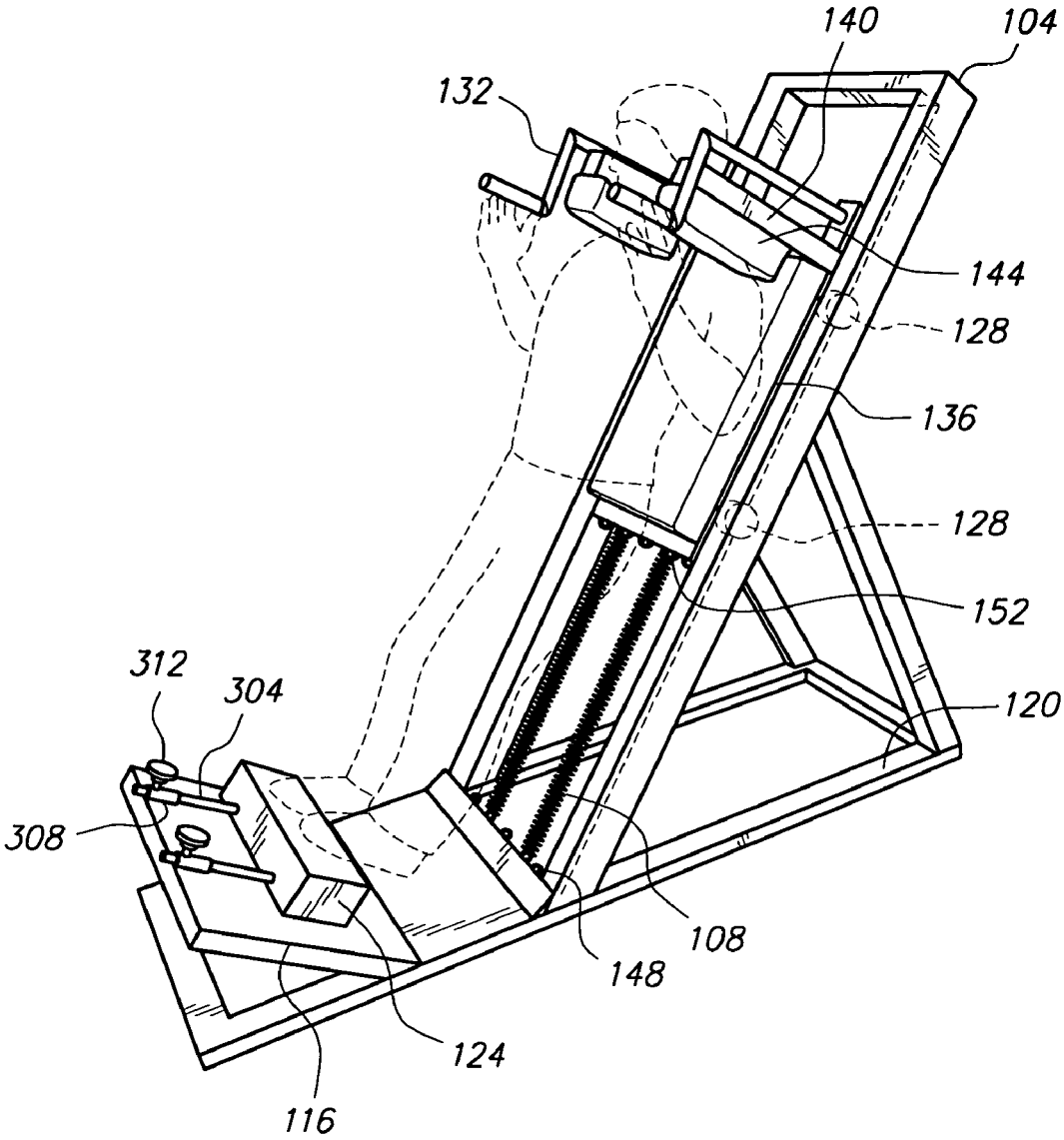
FIG. 3 illustrates a perspective view of an adjustable embodiment of the invention.

In one or more embodiments, the elements of the calf extension training device may be adjustable such as by repositioning them to accommodate the size, strength, or physical characteristics of a user. FIG. 3 illustrates an embodiment of the training device with an adjustable riser 124.

As shown, the riser 124 is not directly attached to the platform 116, but is held to the platform by a riser guide 308 configured to accept a riser extension 304 therethrough. The riser extension 304 is a bar or rod attached to and extending from the riser 124 in one or more embodiments. In one embodiment, the riser guide 308 is a hollow tubular structure with an opening large enough to accept the riser extension 304. It is noted that, though shown as cylindrical in shape, the riser guide 308 and riser extension 304 may have various shapes, such as a square or other shaped tube. The shape of the riser guide 308 may correspond to the riser extension's 304 cross-section, and vice versa in one or more embodiments.

The riser guide 308 allows the riser extension 304 to slide or move back and forth therein. Thus, the riser's 124 movement during adjustment is guided by its riser extension 304 and the riser guide 308. In one or more embodiments, the riser guide 308 is aligned such that it is parallel to the platform 116. This allows the riser 124 to be moved toward or away from the frame 104 on a path parallel to the platform 116. This adjustability is advantageous in that it allows a user to stand closer or further away from the frame 104 as desired or as dictated by physical characteristics such as height.

The riser guide 308 may include one or more threaded holes in its side (if round) or sides configured to accept a pin 312 or other fastener to secure the riser 124 in place. In one embodiment, the riser 124 may be secured by inserting a threaded pin 312 into the riser guide's 308 hole and then tightening the pin against the riser extension 304. This tightening clamps the riser extension 304 in place. Of course, the riser extension 304 may be secured in various ways. Thus, it is noted that any fastener or structure capable of securing the riser extension 304, including but not limited to clamps, screws, clips, nuts, bolts, or a combination thereof may be used.

It is contemplated that some embodiments of the calf extension training device may include more than one riser guide 308. In these embodiments, a corresponding number of riser extensions 304 may be attached to the riser 304. For example, the training device may have two riser guides 308 and two riser extensions 304. This is advantageous because each riser guide 308 and riser extension may be used to guide and secure a portion of the riser 124, such as left and right portions of the riser. This is also advantageous because two separate risers 124 may provided, if desired. For example, a left riser 124 may be used to support the left foot while a right riser supports the right foot of a user. In this manner, support for either foot may be independently adjusted and secured.

Other structures may be used to secure a riser extension 304 as well. For example, a riser extension 304 may be secured by a quick release clamping system such as the quick release clamping systems often found on bicycles. Generally, such systems operate by providing a hollow guide having an opening to accept an adjustable element. When the adjustable element is in the desired position, the opening of the hollow guide is tightened which clamps the adjustable element in place. With regard to the present invention, the riser extension 304 may be inserted into the hollow guide and clamped in place when the riser is 124 positioned as desired.

It is also noted, that the riser 124 may be adjustable without the need for riser guides 308 or riser extensions 304 in some embodiments. For example, the riser 124 may be positioned as desired and then removably attached to the frame 104, the platform 116, or both by one or more pins or by any other fastener, including but not limited to screws, nuts, bolts, or a combination thereof.

It is contemplated that the stops 204 which prevent the sled 112 from moving past a certain point on the frame may be adjustable in some embodiments. For example, in one embodiment, the frame 104 may have a plurality of holes or grooves along its length to accept one or more movable stops. In this manner, the extent the sled 112 can move along the frame 104 may be adjusted for various users, various springs 108, or both.

The supports 140 may be adjustable side to side also. This provides users having different neck and shoulder widths to locate support pads 140 at a desired location on the top of the shoulders.

Training with the calf extension training device will now be described referring to FIGS. 4-5. Generally, a user may utilize the training device by performing one or more repetitions of lifting and lowering the sled 112. The sled 112 provides resistance against the user's motion through one or more springs 108 which are attached to the sled 112 by one or more sled attachment points 152 and to the frame 104 by one or more frame attachment points 148. This resistance provides the training or rehabilitation of the calf muscles because the muscles work against and overcome the resistance during training. In addition, the repetitions of lifting and lowering the sled 112 may also be used to train or rehabilitate joints, tendons, and other body structures associated with the ankles, legs, thighs, and hips. For example, articulation or range of motion of the ankles may be improved through regular training on the training device.

Figure 4:
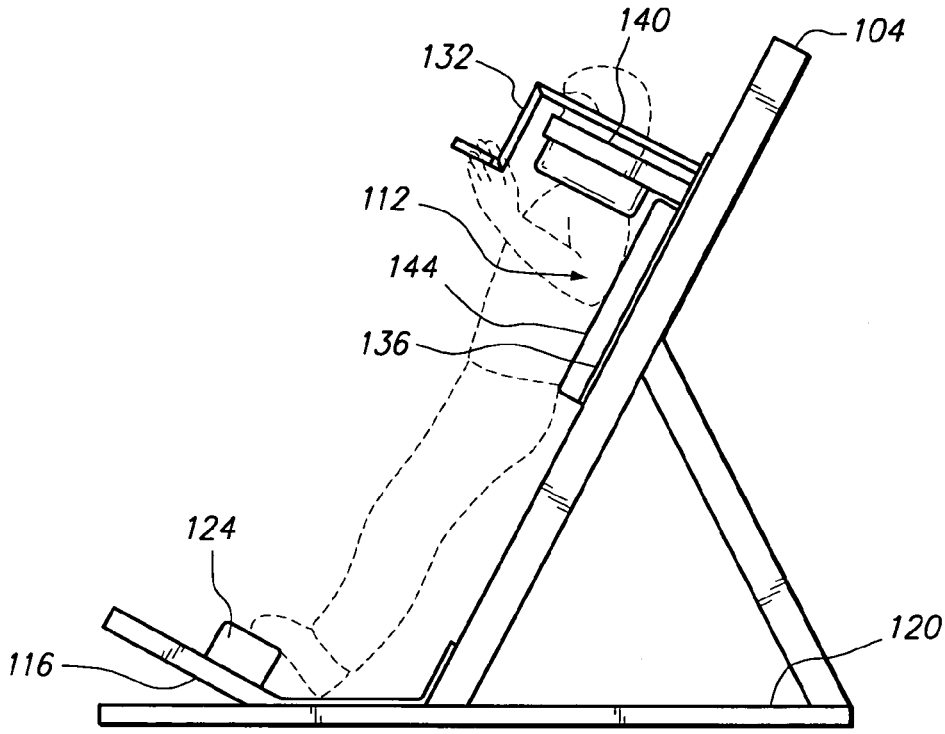
FIGS. 4 and 5 illustrate a method of training according to an embodiment of the invention.
Figure 5:
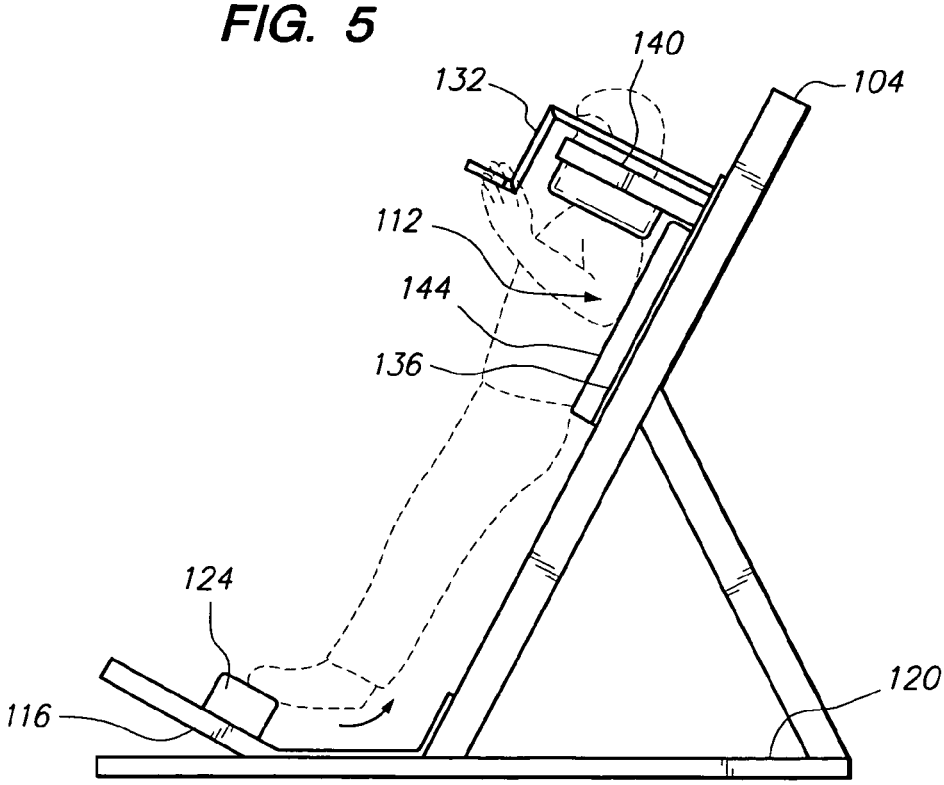

FIGS. 4 and 5 show a user utilizing the calf extension training device to perform a calf extension exercise according to an embodiment of the invention. Generally, the user stands in the training device with the user's feet on the riser 124 and the user's shoulders in contact with the shoulder extensions 140 of the sled 112. The user's head is thus positioned between the shoulder extensions 140. In this position, the resistance from the sled 112 is applied to the user through the user's shoulders. In this manner, the user does not need to exert other forces to lift the sled 112. This is one advantage of the training device. To illustrate, a seated leg extension device may require a user to grasp the seat of the device and exert force through the user's arms to prevent the user's body from moving during training. This is especially so where the training on a seated device involves heavy weights. With the invention herein, training is focused on the calf muscles, in part, because the sled 112 and its resistance are securely supported by the user's shoulders and by the frame 104.

It is noted that focused training of the calf muscles is highly desirable because the calf muscles are used in standing, walking, running, and jumping. Thus, the calf extension training device provides a further advantage in that calf training can occur for longer because the user is not fatigued by having to exert other forces with other muscles.

It is also noted that in one or more embodiments the riser 124 is configured to support a front portion of each foot leaving a back or heel portion of each foot unsupported. This is advantageous in that training is focused on the calf muscles and greater calf muscle extension and contraction may occur when the back or heel portion of the foot is unsupported. This is generally because the calf muscles attach on one end to the back or heel portion of the foot. Of course, a user may stand such that his or her foot is completely supported by the riser 124, however, this may be considered improper form as leaving the heel portion of each foot unsupported helps focus training on the calf muscles.

FIGS. 4 and 5 also show an embodiment where the frame 104 is attached at an angle. In this manner, the user is able to lean into the calf extension training device with the sled 112 supporting the user's back. This is advantageous in that training is further focused on the calf muscles because the training device, through its sled 112, supports the user's body. Thus, the use of other muscles to stabilize or support the user's body is reduced and training may be focused on the calf muscles.

As shown in FIG. 4, the user is standing on the riser 124 leaving the heel portion of his or her feet unsupported. The user's shoulders engage the shoulder extensions 140 through their pads 144 while the user's back is supported by the pad on the sled frame 136. As shown, the user may grasp the hand hold 132 to release the stops or when exercising. Of course, grasping the hand hold 132 is not always required, and the pads 144 may not be provided in all embodiments.

As stated, the sled 112 includes a pad 144 that may cover the surfaces of the sled which a user comes into contact with during training in one or more embodiments. For example, the shoulder extensions 140 and the front of the sled frame 136 may have one or more pads 144 attached thereto. In padded embodiments, the user would engage the sled 112, the sled's shoulder extensions 144, or both through contact with one or more pads 144 such as shown in FIG. 4. However, where there are no pads 144, a user may directly engage the sled 112 or the shoulder extensions 144.

The user may lift the sled 112 along a path or track defined by the frame 104 by exerting an upward force through his or her calf muscles. Generally, this occurs by the user raising his or her body by extending the ankles while front portions of the user's feet are supported by the riser 124. As shown in FIG. 5, lifting the sled 112 stretches the spring 108 which provides resistance against the user's upward force. The sled 112 may be lifted as far as desired or to a certain extent, such as where one or more stops prevent the sled from being lifted or lowered past a certain point.

The user may then reduce the upward force on the sled 112 to allow the sled to return downward to a lower position along the frame. It is noted that the one or more springs 108 continue to exert a downward force as the sled 112 is lowered. In one or more embodiments, the sled 112 may be lowered back to its original position which may be defined by one or more stops below the sled. Reducing the upward force may occur by the user reducing the extension of the user's ankles which consequently lowers the sled 112. Some force against the return motion of the sled 112 may be applied by the user as the sled is lowered. In this manner, training of the calf muscles also occurs as the sled 112 returns.

In one or more embodiments, the sled 112 is guided by the frame 104 as it is lifted and lowered. For example, in the embodiment shown in FIGS. 1 and 2, a sled 112 having wheels 128 moves along the length of a frame 104. This may occur by the wheels 128 rolling within the frame or on or in a track. As shown in FIGS. 1 and 2, the frame 104 comprises two C shaped beams each of which accepts at least one wheel 128 on both sides of the sled 112. When lifted or lowered, the frame 104 guides the wheels 128 allowing the sled 112 to move along the frame's length. In this manner, the calf extension training device ensures that resistance is applied. This enhances calf training because the spring force must be overcome by the calf muscles and because the user does not have to exert any force to control lateral motions of the sled 112 and its corresponding resistance.

It is noted that most if not all of the training performed on the calf extension training device, such as the training described above, may exert some forces on the hips, thighs, legs, and ankles. Thus, the muscles, joints, tendons, and other body structures associated with these body parts may also undergo training, rehabilitation, or both when a user is training.

As stated above, the calf extension training device may be adjustable in one or more embodiments. Thus, adjusting the training device may be included in some embodiments of the method of training. As described above, a user may adjust the position of the riser 124. The user may also adjust the amount of resistance the hip flexor provides such as by replacing one or more springs 108 or by adjusting the angle at which the spring 108 or springs meet the actuator arm 120. Such adjustments may be made according to the user's physical characteristics, such as height or strength, or a training or rehabilitation program.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A calf extension training device comprising:

a base;

a platform, the platform extending from the base;

one or more risers attached to the platform, one or more risers configured to engage a front portion of at least one of a user's feet.

a frame having one or more frame attachment points attached at a bottom end of the frame, the frame extending upward from the base;

a sled, the sled comprising:

a sled frame;

one or more shoulder extensions extending outward from a top end of the sled frame, the shoulder extensions configured to engage one or more of the user's shoulders; and one or more sled attachment points;

wherein the sled is configured to move along the length of the frame; and one or more resistance devices attached to the one or more frame attachment points and the one or more sled attachment points, the one or more resistance devices configured to provide resistance as the sled is lifted and lowered.

2. The calf extension training device of claim 1 wherein the frame comprises two parallel C shaped beams, the parallel C shaped beams configured to accept one or more wheels attached to the sled.

3. The calf extension training device of claim 1 wherein the sled further comprises one or more hand holds.

4. The calf extension training device of claim 1 wherein the sled frame, the one or more shoulder extensions, or both are padded.

5. The calf extension training device of claim 1 wherein a plurality of sled attachment points are attached at a bottom end of the sled frame.

6. The calf extension training device of claim 1 wherein the one or more resistance devices are removably attached to the one or more frame attachment points and the one or more sled attachment points.

7. The calf extension training device of claim 1 wherein the one or more risers is adjustable.

8. A calf extension training device comprising:

a base;

a frame extending upward at an angle from the base, the frame having a top end, a bottom end, and one or more frame attachment points at the bottom end;

a foot support attached to the base or frame;

a sled, the sled comprising:

a sled frame having a top end and a bottom end, the sled frame configured to engage the user's back;

two shoulder extensions at the top end of the sled frame, the two shoulder extensions configured to engage the user's shoulders; and one or more sled attachment points at the bottom end of the sled frame;

wherein the sled is configured to be lifted and lowered along the length of the frame;

one or more springs attached to the one or more frame attachment points and the one or more sled attachment points, the one or more springs configured to provide resistance as the sled is lifted; and one or more riser guides configured to accept one or more riser extensions attached to the one or more risers, wherein the position of the one or more risers may be adjusted and then secured by one or more pins inserted into one or more holes formed in one or more sides of the one or more riser guides.

9. The calf extension training device of claim 8 wherein the at least a portion of the foot support extends at an angle perpendicular to the frame.

10. The calf extension training device of claim 8 wherein the frame comprises two parallel C shaped beams, the parallel C shaped beams configured to accept one or more wheels attached to the sled.

11. The calf extension training device of claim 8 wherein the sled further comprises one or more hand holds.

12. The calf extension training device of claim 8 wherein the sled frame, the one or more shoulder extensions, or both are padded.

13. The calf extension training device of claim 8 wherein the foot support is attached to and extends from the frame.

14. A calf extension training device comprising:

a base;

a platform, the platform extending from the base;

one or more risers attached to the platform, one or more risers configured to engage a front portion of at least one of a user's feet;

a frame having one or more frame attachment points, the frame extending upward from the base;

a sled, the sled comprising:

a sled frame;

one or more shoulder extensions extending outward from a top end of the sled frame, the shoulder extensions configured to engage one or more of the user's shoulders; and one or more sled attachment points;

wherein the sled is configured to move along the length of the frame; and one or more resistance devices attached to the one or more frame attachment points and the one or more sled attachment points, the one or more resistance devices configured to provide resistance as the sled is lifted and lowered and wherein the one or more resistance devices are removably attached to the one or more frame attachment points and the one or more sled attachment points.

15. The calf extension training device of claim 14 wherein the frame comprises two parallel C shaped beams, the parallel C shaped beams configured to accept one or more wheels attached to the sled.

16. The calf extension training device of claim 14 wherein the sled further comprises one or more hand holds.

17. The calf extension training device of claim 14 wherein the sled frame, the one or more shoulder extensions, or both are padded.

18. The calf extension training device of claim 14 wherein a plurality of sled attachment points are attached at a bottom end of the sled frame.

19. The calf extension training device of claim 14 wherein a plurality of frame attachment points are attached at a bottom end of the frame.

20. The calf extension training device of claim 14 wherein the one or more risers is adjustable.

21. A calf extension training device comprising:

a base;

a frame extending upward at an angle from the base, the frame having a top end, a bottom end, and one or more frame attachment points at the bottom end;

a foot support attached to the base or frame;

a sled, the sled comprising:

a sled frame having a top end and a bottom end, the sled frame configured to engage the user's back;

two shoulder extensions at the top end of the sled frame, the two shoulder extensions configured to engage the user's shoulders; and one or more sled attachment points at the bottom end of the sled frame;

wherein the sled is configured to be lifted and lowered along the length of the frame;

one or more springs attached to the one or more frame attachment points and the one or more sled attachment points, the one or more springs configured to provide resistance as the sled is lifted; and one or more riser guides configured to accept one or more riser extensions attached to the one or more risers, wherein the position of the one or more risers may be adjusted and then secured by one or more threaded pins threaded into one or more threaded holes formed in one or more sides of the one or more riser guides.

22. The calf extension training device of claim 21 wherein the at least a portion of the foot support extends at an angle perpendicular to the frame.

23. The calf extension training device of claim 21 wherein the frame comprises two parallel C shaped beams, the parallel C shaped beams configured to accept one or more wheels attached to the sled.

24. The calf extension training device of claim 21 wherein the sled further comprises one or more hand holds.

25. The calf extension training device of claim 21 wherein the sled frame, the one or more shoulder extensions, or both are padded.

26. The calf extension training device of claim 21 wherein the foot support is attached to and extends from the frame.

* * * * *